US007287794B2

(12) United States Patent
Bourgraf, Jr. et al.

(10) Patent No.: US 7,287,794 B2
(45) Date of Patent: Oct. 30, 2007

(54) ARRESTING DEVICE OF A COT FASTENING SYSTEM

(75) Inventors: Elroy E. Bourgraf, Jr., Maineville, OH (US); Jeffrey A. Szekely, Morrow, OH (US); Timothy R. Wells, Hillsboro, OH (US); Abraham M. Arnold, Jr., Sabrina, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 17 days.

(21) Appl. No.: 11/210,264

(22) Filed: Aug. 23, 2005

(65) Prior Publication Data

US 2006/0131909 A1 Jun. 22, 2006

Related U.S. Application Data

(60) Provisional application No. 60/603,713, filed on Aug. 23, 2004.

(51) Int. Cl.
*A61G 1/02* (2006.01)

(52) U.S. Cl. ..... 296/20; 248/503; 410/66

(58) Field of Classification Search ..... 296/19, 296/20; 5/511; 248/500, 503, 503.1; 410/66, 410/77, 80; 188/32
See application file for complete search history.

(56) References Cited

U.S. PATENT DOCUMENTS

| | | | | |
|---|---|---|---|---|
| 1,477,815 | A * | 12/1923 | Denning | 296/19 |
| 3,005,656 | A * | 10/1961 | Fulton | 296/19 |
| 3,918,554 | A * | 11/1975 | Bourgraf et al. | 296/19 |
| 4,957,121 | A * | 9/1990 | Icenogle et al. | 296/19 |
| 5,092,722 | A | 3/1992 | Reazer, III et al. | |
| 5,913,559 | A * | 6/1999 | Sexton et al. | 296/20 |
| 6,796,757 | B1 * | 9/2004 | Way et al. | 296/20 |

* cited by examiner

*Primary Examiner*—Lori L. Lyjak
(74) *Attorney, Agent, or Firm*—Dinsmore & Shohl LLP

(57) ABSTRACT

An arresting device used in a cot fastening system for an ambulance is disclosed. The arresting device includes an extension beam providing a bolt pattern, and a pair of antler brackets each having a mounting hook portion. The pair of antler brackets is mounted to the extension beam. The present invention may be used with a plurality of prior art cots, without requiring modifications or installation changes to the ambulance or the cot fastening system to which the arresting device is a part thereof.

20 Claims, 9 Drawing Sheets

ARRESTING DEVICE OF A COT FASTENING SYSTEM

CROSS REFERENCE TO RELATED APPLICATION

The present application claims priority to U.S. Provisional Patent Application No. 60/603,713, filed Aug. 23, 2004.

FIELD OF THE INVENTION

The present invention relates to cot fastening systems and in particular, to a floor-mounted arresting device of the antler type used in a cot fastening system for an ambulance.

BACKGROUND OF THE INVENTION

In ambulances and other emergency/rescue vehicles, removable, wheeled cots or stretchers are often provided for convenient and comfortable patient transportation from a remote accident site to the emergency vehicle. These cots or stretchers are often referred to as "roll-in" devices, and generally feature a plurality of wheels for inserting and removing the cot from the emergency vehicle, as well as an adjustable or multi-level fold down carriage supporting a set of wheels which enables the cot to be easily rolled along sidewalks, roads, or other access surfaces.

The mobile patient transportation cots or similar devices commonly include a structural frame, which is often tubular in nature, to provide lightweight support for the patient and the wheels, casters or other rolling mechanisms attached thereto. Once the patient is rolled to the emergency vehicle on the cot, the undercarriage may be collapsed and folded under the cot to facilitate insertion of the cot into the emergency vehicle. The cot is then rolled into the emergency vehicle and fastened into position for safe transportation.

A prior art cot fastening system 10 is illustrated by FIG. 1A. The cot fastening system comprising a front arresting device 20, and a separate rear fastening device or locking bar 30. The front arresting device 20 is used to secure the front wheels of the cot and the locking bar 30 is used to secure the cot frame. Such a cot fastening system has been widely used in the industry for a number of years. As shown in FIG. 1B, the front arresting device, often referred to generally as the "antlers," includes a bracket with a pair of upwardly, extending hook-like members 40, which curve to the rear of the emergency vehicle 45 and are designed to receive and effectively hook onto portions of the forward support frame members 50 of the cot 60, as shown in FIG. 1B. This antler bracket 20 thereby limits forward movement of the cot within the emergency vehicle. The rear locking bar 30 is thereafter secured to the cot frame to secure the cot against further rolling movement within the emergency vehicle.

While such cot fastening systems have been widely and successfully used, there are a plurality of designs for cots and other wheeled devices utilized in various emergency vehicles and the like, and interchangeable use of prior cot fastening systems often required modification of the fastening system itself or its installation, or adjustments to the system. In particular, prior art fastening system all use different mounting assemblies which depends on the particulars of the cot in use.

For example, prior art antler brackets require alternate antler bracket mounting locations in the floor of the emergency vehicle for the various types of cots, such as for example, the Model 30 and 35 series Ferno brand cots. Often, this requires installation of an additional mounting plate in the floor of the emergency vehicle if desiring to interchange one cot with another. However, when multiple emergency vehicles containing various types of cot fastening systems respond to an emergency, delays in removing patients from the scene may result due to the lack of interoperability, as particular cot must be match up with particular fastening systems.

This problem is further acerbated by the fact that from a liability standpoint, some ambulance manufacturers must provide the floor cot mounting hardware (mount, locking bar, and antler bracket) that matches the cot being used (i.e., a Ferno brand cot must have Ferno brand floor hardware installed). Should an end user be considering a cot change or addition while at the same time ordering a new ambulance, the cot decision must be made before the mounts are installed in the new ambulance. Accordingly, a cot fastening system which accommodates a broader range of cot models and which automatically and dependably accepts and functions properly with those various models without modification or adjustment to the ambulance or cot fastening system to which the arresting device is a part thereof, is still a desire in the industry in order to reduce the number of issues regarding interoperability.

SUMMARY OF THE INVENTION

It is against the above background that the present invention provides improvements and advancements over the prior art. In particular, the present invention is an improved floor mounted arresting device for a cot fastening system that accepts a plurality of cots and devices of differing designs, without requiring modifications or installation changes to the ambulance or the cot fastening system to which the arresting device is a part thereof.

In one embodiment, an arresting device used in a cot fastening system for an ambulance is disclosed. The device comprises an extension beam providing a bolt pattern, and a pair of antler brackets each having a mounting hook portion. The pair of antler brackets is mounted to the extension beam.

In another embodiment, an arresting device used in a cot fastening system for an ambulance is disclosed. The device comprises an extension beam having first and second ends and providing a bolt pattern between the first and second ends. A pair of antler brackets each having a mounting hook portion is provided. The pair of antler brackets is mounted to the extension beam adjacent the first end and forward of the bolt pattern. A pair of extension braces each having a first end mounted to the extension beam and a second end mounted adjacent a respective one of the mounting hook portion is also provided.

In still another embodiment, an arresting device used in a cot fastening system for an ambulance is disclosed. The device comprises an extension beam having first and second ends and providing a bolt pattern between the first and second ends. A bump guard is mounted to the extension beam at the second end. A pair of antler brackets each having a mounting hook portion is provided. The pair of antler brackets is mounted to the extension beam adjacent the first end and forward of the bolt pattern. A pair of extension braces each having a first end mounted to the extension beam and a second end mounted adjacent a respective one of the mounting hook portion forward of the bolt pattern is also provided.

These and other features and advantages of the invention will be more fully understood from the following description of an embodiment of the invention taken together with the accompanying drawings.

BRIEF DESCRIPTION OF THE DRAWINGS

The following detailed description of the embodiments of the present invention can be best understood when read in conjunction with the following drawings, where like structure is indicated with like reference numerals and in which.

DETAILED DESCRIPTION OF THE INVENTION

Figure 2:
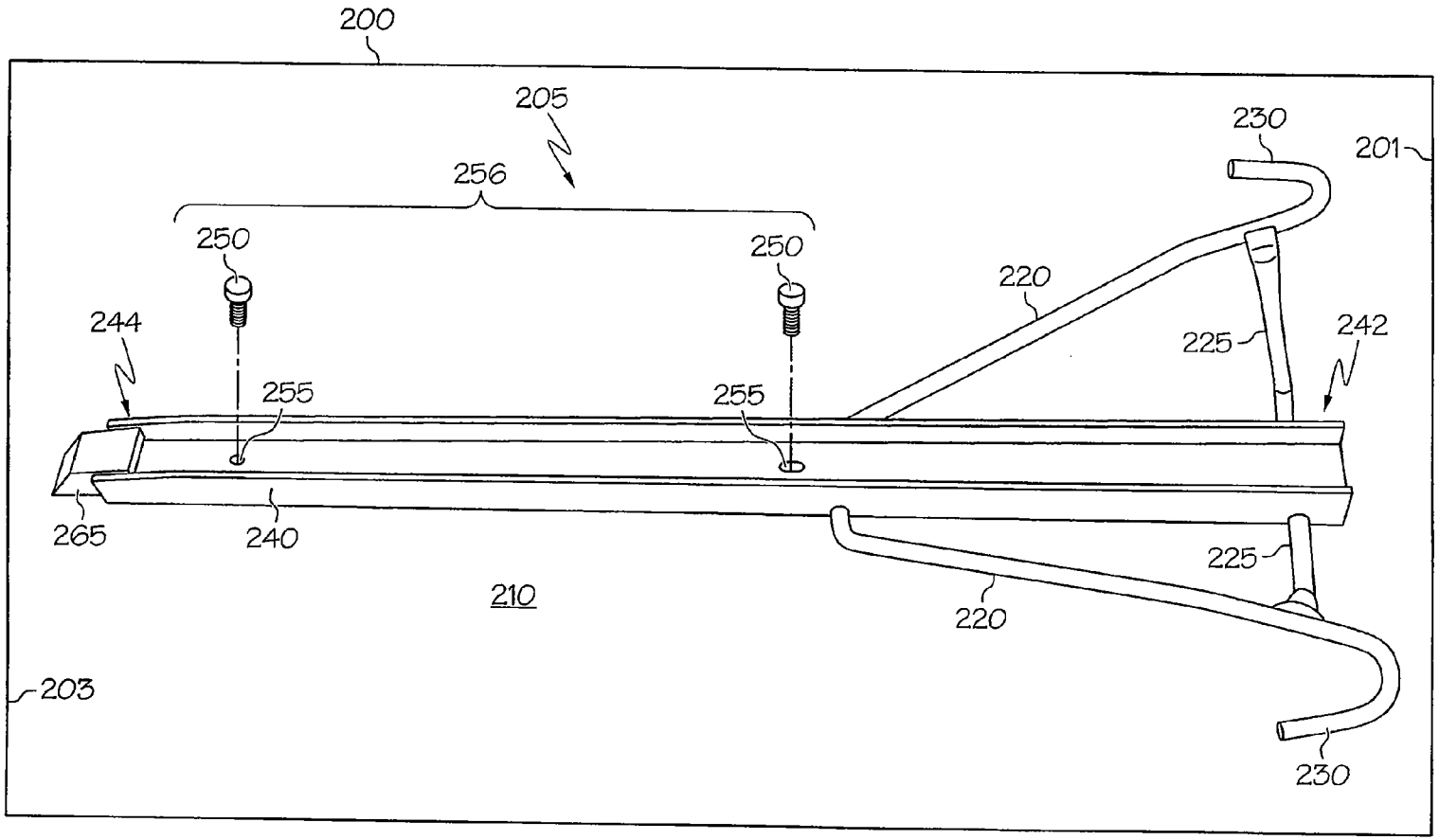
FIG. 2 is an elevated side perspective view of an arresting device of a cot fastening system of the present invention.

Referring now to the drawings in detail, wherein like numerals indicate the same elements throughout the views, FIG. 2 illustrates a partial perspective view of the rear transport portions of an emergency vehicle 200, having a forward end 201 and rear end 203, into which a wheeled cot, stretcher or similar patient transfer device is to be placed. While the present invention is applicable to nearly any wheeled device having a support frame and which is to be secured along a substantially planar surface, the present invention will be shown and described in relation to a preferred application of the invention wherein a wheeled emergency cot is to be secured along the floor 210 of the emergency vehicle 200.

The term "cot" will be understood to refer to any of a variety of patient transfer devices, stretchers, carts or incubator transporters commonly known and utilized in the industry (e.g. Model 26 Series, Model 29-M, Model 30 Series, Models 35-A, 35-A+, and 35-P ProFlexx, Models 93ES and 93EX, XCalibur Cots, etc., such as available from Ferno-Washington, Inc. of Wilmington, Ohio). Such cots often have a pair of front loading wheels to facilitate insertion and removal of the device from an emergency vehicle, as well as a rear fold-down wheel assembly, including a plurality of wheels to facilitate rolling movement of the cot between the emergency vehicle and other locations. While the cots illustrated and described herein are contemplated as including wheels to facilitate movement of the cot along a planar surface, such wheels could be substituted by other devices such as slides, rollers, skis or the like.

Figure 1A:
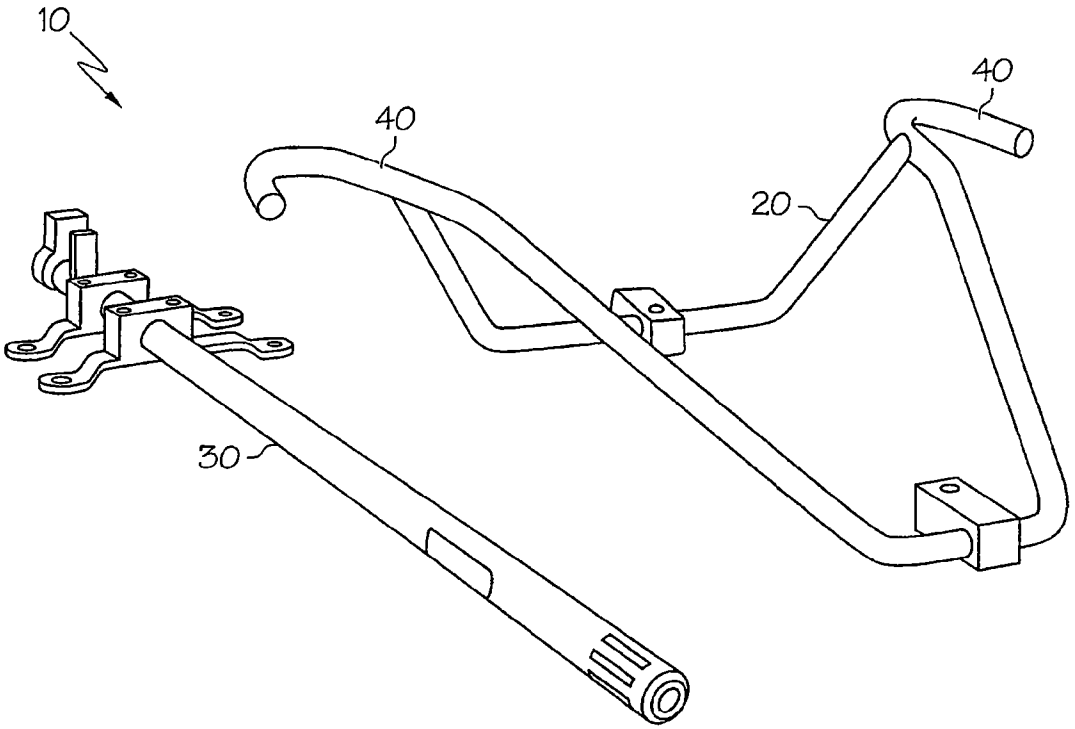
FIG. 1A (PRIOR ART)
FIG. 1A is an elevated perspective view of a prior art cot fastening system.
Figure 1B:
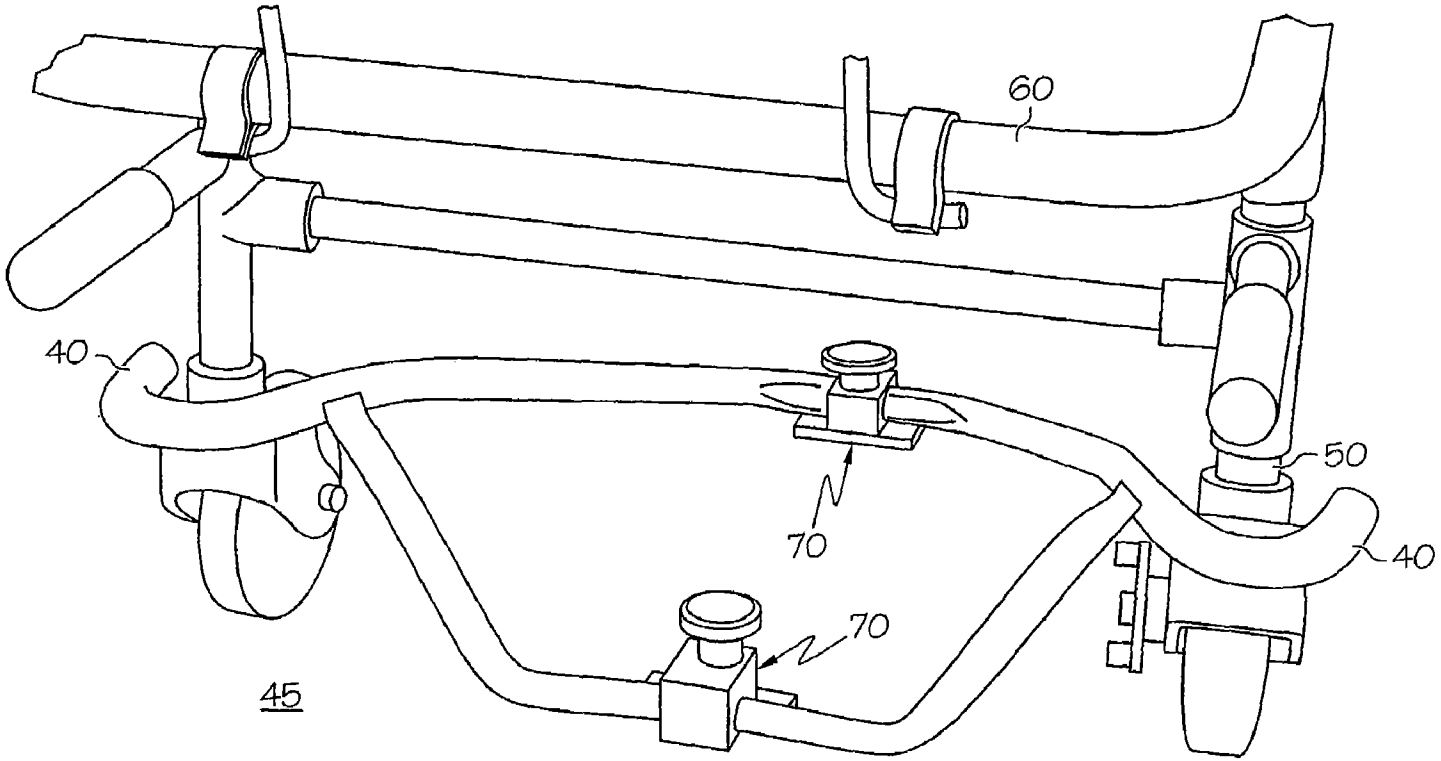
FIG. 1B (PRIOR ART)
FIG. 1B is a front perspective view of a prior art cot fastening system, showing the antler bracket holding the loading end of an cot.

The arresting device 205 according to the present invention and as shown in FIGS. 2-5 fits the conventional mount spacing or bolt pattern 70 provided to the floor 210 of the emergency vehicle 200 as shown FIGS. 1B and 2. The arresting device 205 is provided with a pair of antler brackets 220, having mounting hook portions 230, and an extension beam 240. The mounting hook portions 230 are shaped and sized to engage a forward portion of a cot when situated in the ambulance 200. Each of the pair of antler brackets 220 has a respective extension brace 225. Each of the respective extension braces 225 have a first end mounted to the extension beam 240 and a second end mounted adjacent the mounting hook portion 230. In one embodiment, the antler brackets 220 and extension braces 225 are metal and are mounted to the vertical sides of the extension beam. In other embodiments, the brackets and braces may be any other suitable material and may be mounted to the vertical sides, an upper side, a bottom side, and combinations thereof.

In one embodiment, the extension beam 240 is a substantially straight metal I-beam, and in other embodiments may be any other suitable elongated mounting material. The extension beam 240 has a first end 242 and second end 244 remote from the first end. As shown in FIG. 2, each one of the pair of antlers 220 is mounted adjacent the first end 242 and forward of a provided bolt pattern 256 such that the mounting hook portions 230 are vertically adjacent the first end 242 of the extension beam 240. The arresting device 205 also includes a polymer bump guard 265, which is mounted to the extension beam 240 at the second end 244.

By mounting the antler bracket 220 along the extension beam 240, unlike provided in prior art antler brackets, the mounting hook portions 230 are moved forward of the bolt pattern 70 provided in the ambulance floor 210, and more towards the forward end 201 of the emergency vehicle 200. By virtue of moving the mounting hook portions 230 forward via the use of the extension beam 240, no modification to the floor 210 of the emergency vehicle 200 or other components of the cot fastening system to which the arresting device is a part thereof, is required to accommodate a wider range of prior art cots.

Removable fasteners 250 are provided to releaseably mount the cot-fastening device 205 to the floor 210 of the ambulance 200. The removable fasteners 250 permit center mounting of a cot and facilitate easier cleaning of the vehicle floor and sidewall. The removable fasteners 250 are each sized to have a portion pass through respective holes 255 of the bolt pattern 256 provided in the extension beam 240. It is to be appreciated that the bolt pattern 256 of the extension beam matches the bolt pattern 70 provided in the ambulance floor 210, such that the removable fasteners 250 may releaseably engage the ambulance through the bolt pattern 256 of the extension beam 240. In one embodiment, the removable fasteners 250 are knurled knob threaded bolts. In another embodiment, illustrated by FIG. 3, the holes 255 of the bolt pattern 256 may be elongated to provide a range of adjustability to the bolt pattern 70 provided in the ambulance floor.

A conventional and separate rear-fastening rail is also provided in conjunction with the arresting device to secure the cot against rolling movement within the emergency vehicle. Together, the arresting device 205 and rear-fastening rail form a cot fastening system. One suitable rear-fastening rail 30 is shown in FIG. 1A. As this rear fastening rail 30 is conventional, no further discussion is provided. Other features and advantages of the arresting device 205 are shown in remaining FIGS. 3-8.

Figure 3:
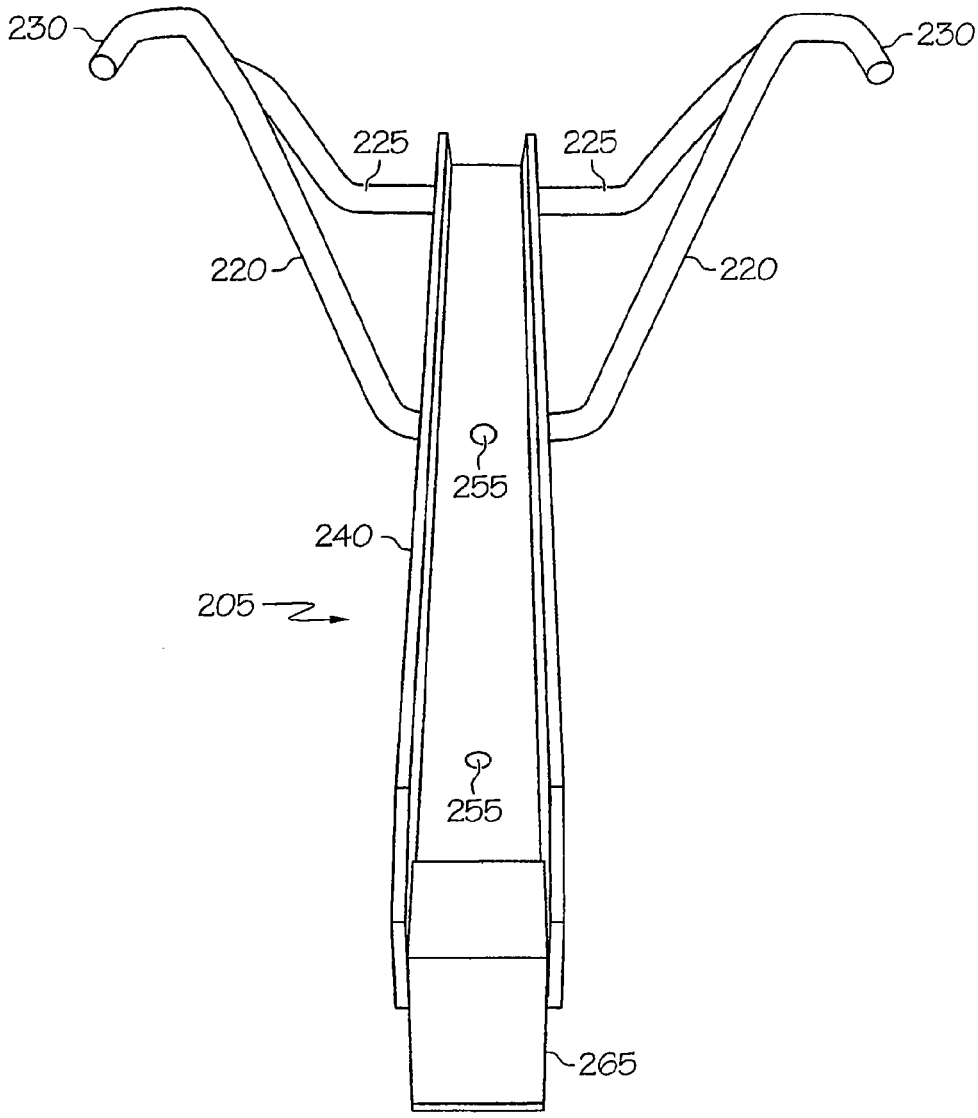
FIG. 3 is an elevated perspective view of the arresting device of FIG. 2, showing the loading end and extension beam portion thereof.
Figure 4:
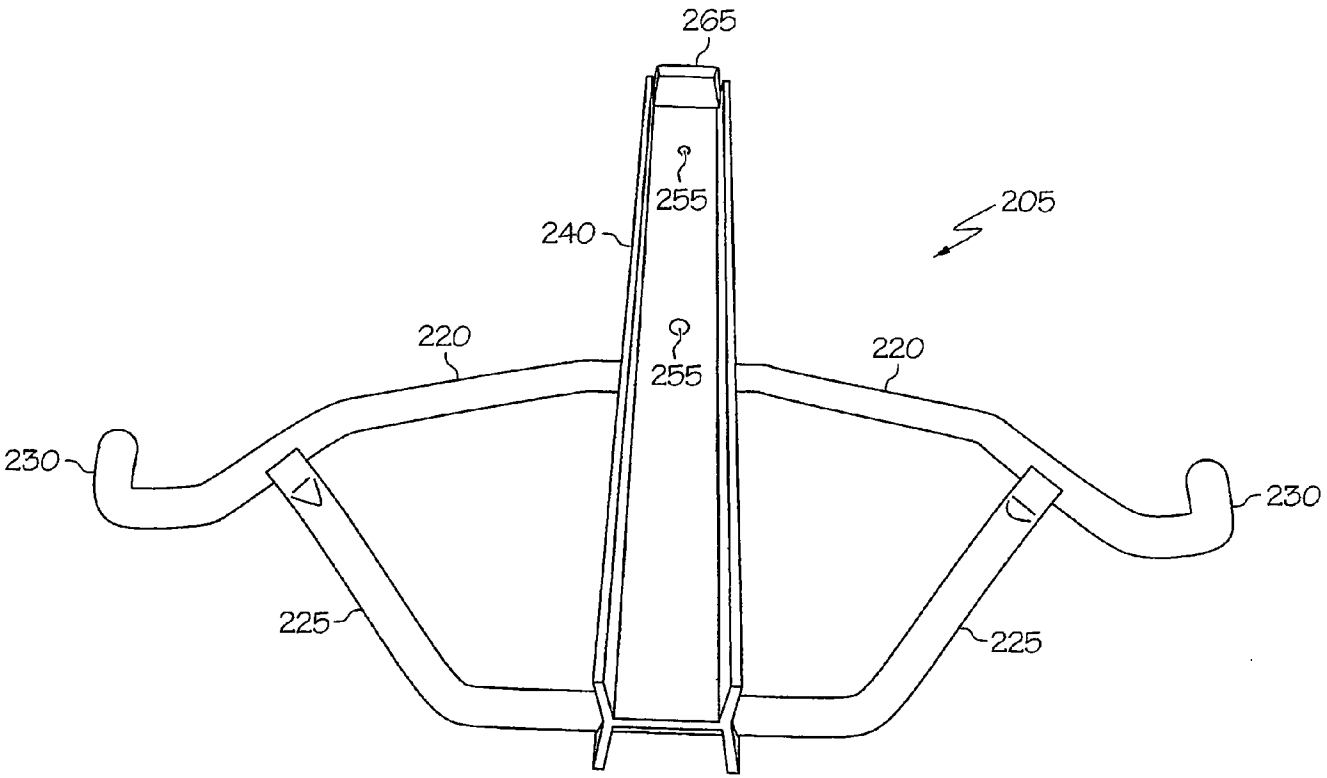
FIG. 4 is an elevated perspective view of the arresting device of FIG. 2, showing the hook portions thereof.
Figure 5:
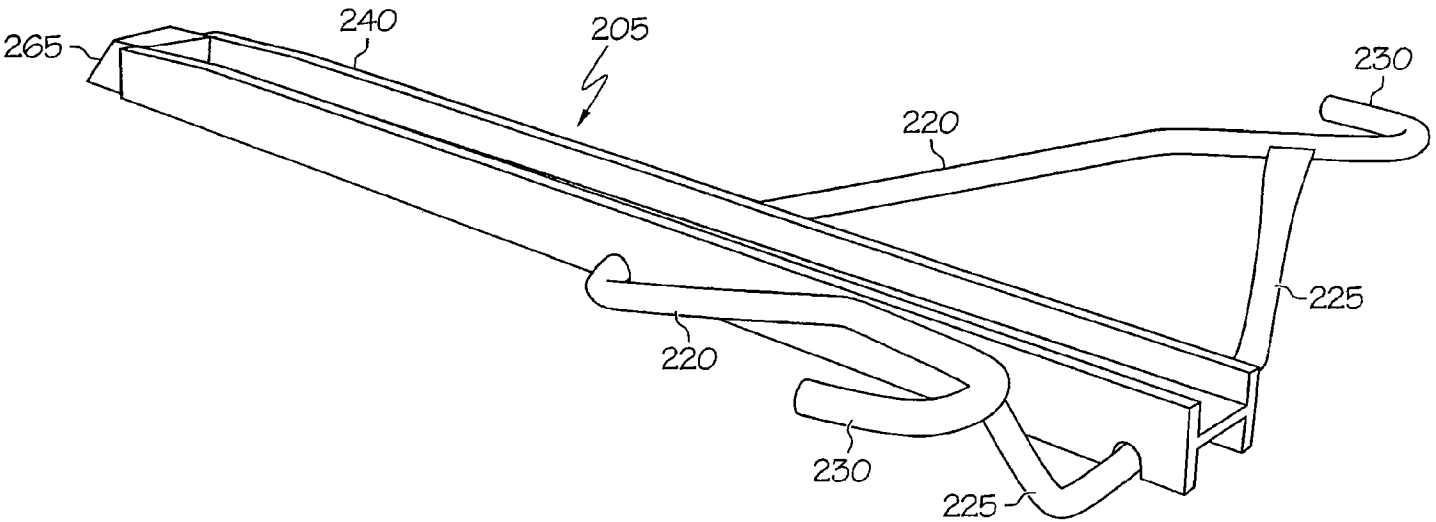
FIG. 5 is another elevated perspective view of the arresting device of the cot fastening system of FIG. 2.
Figure 6:
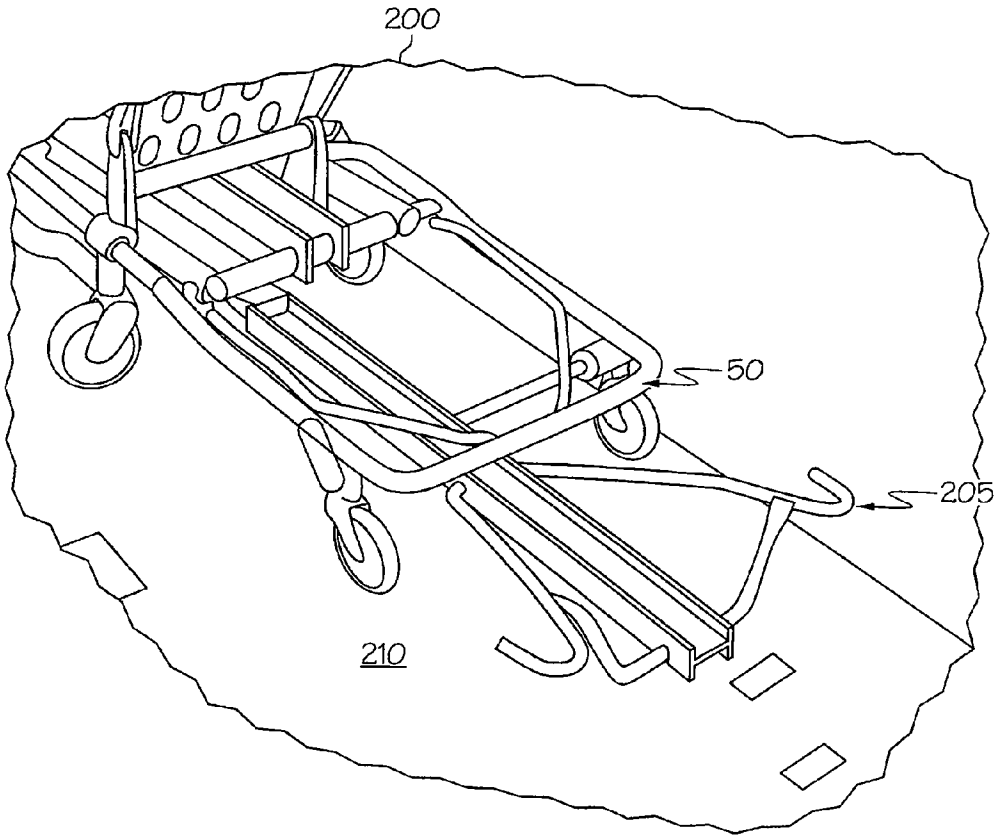
FIGS. 6 and 7 are elevated side perspective views of an arresting device of a cot fastening system of the present invention depicted being used to secure a prior art cot.
Figure 7:
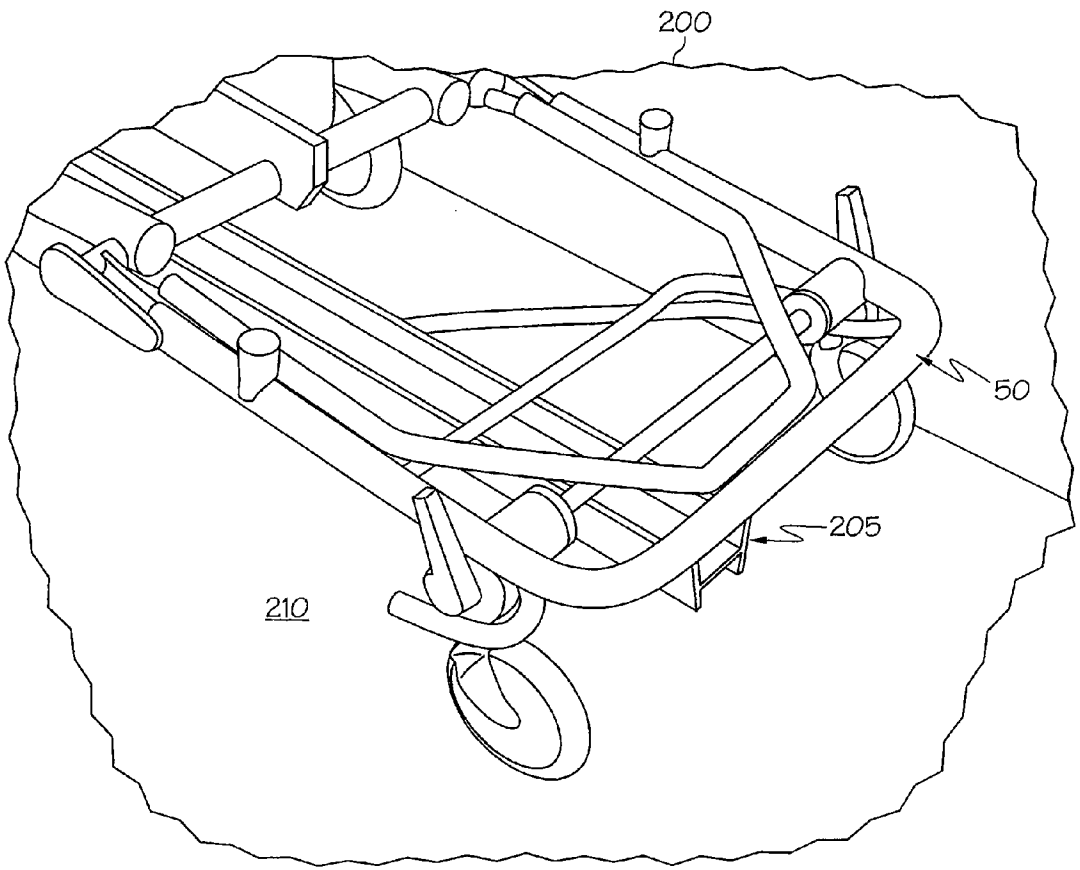
Figure 8:
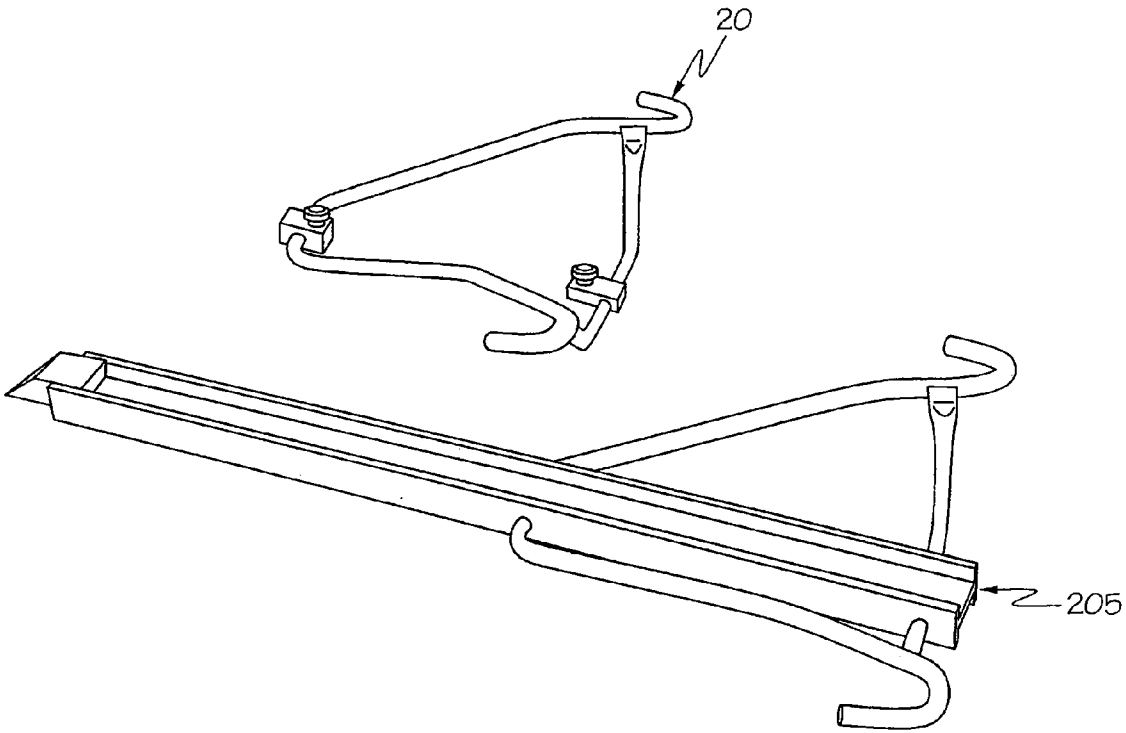
FIG. 8 is an elevated perspective view showing a comparison between a prior art antler bracket and an arresting device according to the present invention.

FIG. 3 is an elevated perspective view of the arresting device 205 of FIG. 2, showing the loading end and extension beam portion thereof. FIG. 4 is an elevated perspective view of the arresting device 205 of FIG. 2, showing the holding end and hook portions thereof; and FIG. 5 is another elevated perspective view of the arresting device 205 of FIG. 2. FIGS. 6 and 7 are elevated side perspective views of the arresting device 205 depicted as being used to secure a prior art cot 50. FIG. 8 is an elevated perspective view showing a comparison between a prior art antler bracket 20 and the arresting device 205 according to the present invention.

It will be apparent to those skilled in the art that various changes may be made without departing from the scope of the invention which is not considered limited to what is described in the specification. Accordingly, it is intended that the invention not be limited to the disclosed embodiments, but that it have the full scope permitted by the language of the following claims.

What is claimed is:

1. An arresting device used in a cot fastening system of an ambulance, said arresting device comprising:

an extension beam providing a bolt pattern; and a pair of antler brackets each having a mounting hook portion, said pair of antler brackets being mounted to said extension beam.

2. The arresting device of claim 1 further comprising removable fasteners that are each sized to have a portion pass through said bolt pattern and configured to be releaseably engaged to the ambulance.

3. The arresting device of claim 1, wherein said extension beam is a substantially straight I-beam.

4. The arresting device of claim 1, wherein each of said pair of antler brackets has a respective extension brace.

5. The arresting device of claim 1, wherein each of said pair of antler brackets has a respective extension brace, said respective extension brace having a first end mounted to said extension beam and a second end mounted adjacent said mounting hook portion.

6. The arresting device of claim 1, wherein said pair of antlers is mounted to sides of said extension beam.

7. The arresting device of claim 1, wherein said extension beam has a first end and second end remote from said first end, said pair of antlers is mounted adjacent said first end.

8. The arresting device of claim 1, wherein said pair of antlers is mounted to said extension beam adjacent said bolt pattern.

9. The arresting device of claim 1, wherein said extension beam has a first end and second end remote from said first end, said pair of antlers is mounted adjacent said first end and forward of said bolt pattern.

10. The arresting device of claim 1, wherein said extension beam has a first end and second end remote from said first end, and said arresting device further comprises a bump guard mounted to said extension beam at said second end.

11. The arresting device of claim 1, wherein said extension beam has a first end and second end remote from said first end, said pair of antlers is mounted adjacent said first end, and said arresting device further comprises a bump guard mounted to said extension beam at said second end.

12. The arresting device of claim 1, wherein said extension beam has a first end and second end remote from said first end, said pair of antlers is mounted adjacent said first end and forward of said bolt pattern, and said arresting device further comprises a bump guard mounted to said extension beam at said second end.

13. The arresting device of claim 1, wherein said extension beam has a first end and second end remote from said first end, and said pair of antlers is mounted forward of said bolt pattern such that said hook portions are vertically adjacent said first end.

14. The arresting device of claim 1, wherein said extension beam has a first end and second end remote from said first end, said pair of antlers is mounted forward of said bolt pattern such that said hook portions are vertically adjacent said first end, and said arresting device further comprises a bump guard mounted to said extension beam at said second end.

15. An arresting device used in a cot fastening system of an ambulance, said arresting device comprising:

an extension beam having first and second ends and providing a bolt pattern between said first and second ends;

a pair of antler brackets each having a mounting hook portion, said pair of antler brackets being mounted to said extension beam adjacent said first end and forward of said bolt pattern; and a pair of extension braces each having a first end mounted to said extension beam and a second end mounted adjacent a respective one of said mounting hook portion.

16. The arresting device of claim 15, wherein said second end of each said pair of extension braces is mounted forward of said bolt pattern.

17. The arresting device of claim 15 further comprises a bump guard mounted to said extension beam at said second end.

18. The arresting device of claim 15 further comprising removable fasteners that are each sized to have a portion pass through said bolt pattern and configured to be releaseably engaged to the ambulance.

19. The arresting device of claim 15, wherein said cot fastening system further comprises a rear fastening device configured to secure a rear portion a cot, wherein said arresting device secure a forward portion of the cot, when said cot is situated in the ambulance.

20. An arresting device used in a cot fastening system of an ambulance, said arresting device comprising:

an extension beam having first and second ends and providing a bolt pattern between said first and second ends;

a bump guard mounted to said extension beam at said second end;

a pair of antler brackets each having a mounting hook portion, said pair of antler brackets being mounted to said extension beam adjacent said first end and forward of said bolt pattern; and a pair of extension braces each having a first end mounted to said extension beam and a second end mounted adjacent a respective one of said mounting hook portion forward of said bolt pattern.

* * * * *